US006328675B1

(12) United States Patent
Kaye

(10) Patent No.: US 6,328,675 B1
(45) Date of Patent: Dec. 11, 2001

(54) EXERCISE BALL

(76) Inventor: Lowell Kaye, 1065 SW. 15th Ave., Delray Beach, FL (US) 33444-1265

( * ) Notice: Subject to any disclaimer, the term of this patent is extended or adjusted under 35 U.S.C. 154(b) by 0 days.

(21) Appl. No.: 09/574,019

(22) Filed: May 19, 2000

(51) Int. Cl.[7] ..... A63H 13/00

(52) U.S. Cl. ..... 482/44; 446/198; 446/199; 446/200

(58) Field of Search ..... 446/220, 197–199, 446/226; 473/227, 183, 267, 486, 490; 482/44

(56) References Cited

U.S. PATENT DOCUMENTS 4,929,211 * 5/1990 Resnick et al. ..... 446/14
5,921,840 * 7/1999 Diresta et al. ..... 446/198

* cited by examiner

*Primary Examiner*—Glenn E. Richman
(74) *Attorney, Agent, or Firm*—Oltman, Flynn & Kubler

(57) ABSTRACT

A manually squeezable and resilient exercise ball having an outwardly protruding, rounded nipple that simulates the nipple of a woman's breast, and a ring on the surface of the ball encircling the nipple and having an irregular surface simulating the areola of a woman's breast.

5 Claims, 1 Drawing Sheet

EXERCISE BALL

BACKGROUND OF THE INVENTION

1. Field of the Invention

This invention relates to a ball for exercising a person's hands and relieving stress.

2. Prior Art

Various rubber balls, tennis balls, and the like have been used by persons to strengthen the hands and forearms by exercises that involve alternately squeezing the ball and relieving hand pressure on it.

BRIEF SUMMARY OF THE INVENTION

The present invention is directed to a novel exercise ball which may be used for the purposes just mentioned but is primarily intended for improving the user's manual dexterity and the tactile sensitivity of his fingers, particularly the fingertips. The ball of this invention is spheroidal and has a soft surface with a feel to a person's fingers closely simulating the feel of human skin. The ball as a whole is manually deformable and resilient, with a viscosity closely comparable to that of a woman's breast. The ball presents an outwardly protruding, rounded nipple surrounded by a ring that presents small surface irregularities. The nipple and the ring on the surface of the present ball closely simulate in shape and feel the nipple and areola of a woman's breast.

A principal object of this invention is to provide a novel exercise ball that may be used by a person to strengthen his hands, to improve his manual dexterity, to improve the tactile sensitivity of his fingers, and to relieve stress.

Further objects of this invention will be apparent from the following detailed description of a presently preferred embodiment thereof, shown in the accompanying drawings.

DETAILED DESCRIPTION OF THE PRESENT INVENTION

Figure 1:
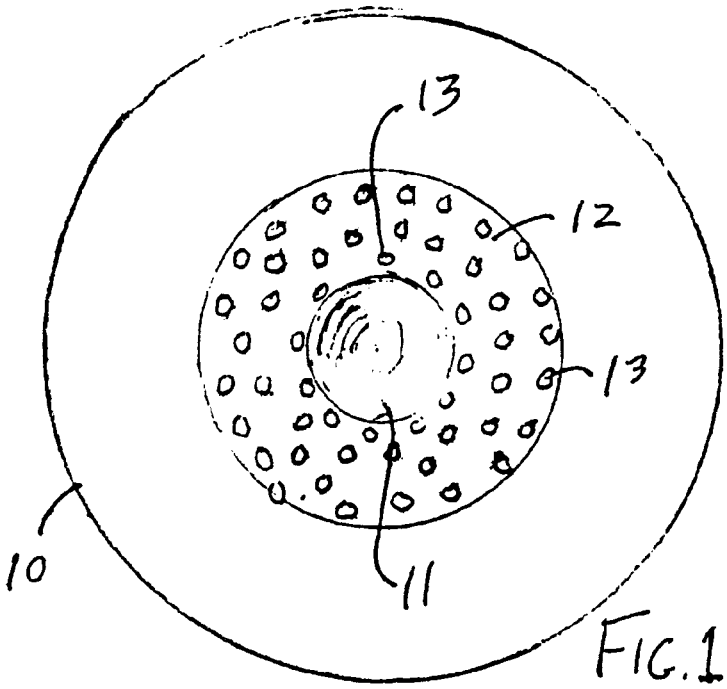
FIG. 1 is a front elevation of the present exercise ball.
Figure 2:
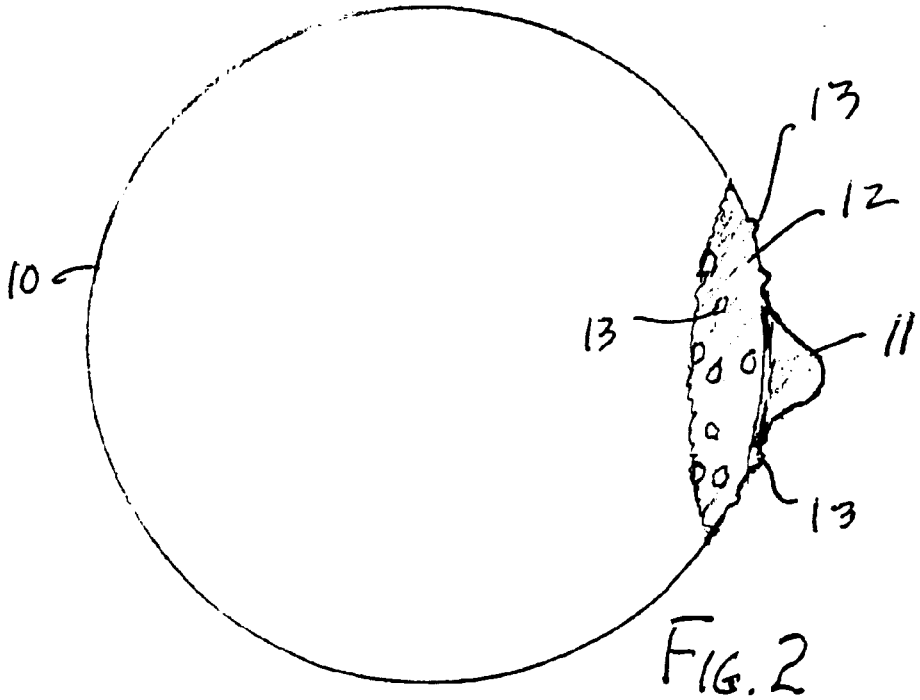
FIG. 2 is a side elevation of this ball.

Before explaining the present invention in detail it is to be understood that the invention is not limited in its application to the particular arrangement shown and described since the invention is capable of other embodiments. Also, the terminology used herein is for the purpose of description and not of limitation.

The exercise ball of the present invention is a spheroidal body of manually deformable and resilient construction. As shown in the drawings, it has a spherical body 10 with an outwardly protruding, rounded nipple 11 on one side surrounded by a ring 12 of irregular surface configuration with small, rounded bumps or peaks 13 projecting out from the spherical surface of the ball. The respective shapes of nipple 11 and ring 12 and their feel to a person's fingers closely simulate the configurations and feel of the nipple and areola of a woman's breast. Likewise, the rest of the ball's surface is soft and smooth, resembling substantially the texture of a woman's breast away from the nipple and areola.

In one practical embodiment of the invention, the spherical body 10 has a diameter of about 3 inches, and the ring 12 has an inside diameter of about ½ inch and an outside diameter of about 1⅜ inches. Obviously, one or more of these dimensions might be changed without departing from the spirit and scope of the present invention. The nipple 11 and the ring 12 are darker colored than the surrounding area of the ball's surface. Preferably, the ball's cover is of rubber-like material having a soft tactile feel that closely resembles that of the skin of a woman's breast. The interior of the ball is any suitable non-toxic material of relatively high viscosity that is manually deformable and resilient, closely resembling those properties of a woman's breast. For example, the filler material may be corn syrup, a viscous gel, a viscous liquid, granulated rubber, ground up shells, or sand.

The psychological effect of the present exercise ball on the typical male is suggested by the following selections from the scholarly literature:

Homer, *The Iliad*, book XIV, (speaking of the goddess Aphrodite):

"She spoke and loosened from her bosom the embroidered girdle of many colors into which all her allurements were fastened. In it was love and in it desire and in it blandishing persuasion which steals the mind even of the wise."

Samuel Johnson to David Garrick, in Boswell's *Life of Johnson*:

"I'll come no more behind your scenes, David; for the silk stockings and white bosoms of your actresses excite my amorous propensities."

John Betjeman, *The Olympic Girl*:

"Oh! Would I were her racket pressed

With hard excitement to her breast."

Just exactly how a person might use the present exercise ball would seem to be determined by his imagination, tempered perhaps by life experiences. Bearing in mind the mandate of 35 U.S.C. 112 that the specification be "concise," all the various possible techniques of using this ball will not be set forth in detail. But in all cases the unique configuration, surface properties and details, and the deformable and resilient physical characteristics of this ball are intended to dispose the user to develop his finger dexterity and tactile sensitivity, and at the same time to experience stress relief by stimulating his imagination erotically.

I claim:

1. A manually squeezable and resilient ball having a single outwardly protruding, rounded nipple simulating the nipple of a woman's breast, and a ring on the surface of said ball encircling said nipple and having an irregular surface simulating the areola of a woman's breast, said ball over substantially its entire periphery away from said nipple and ring having a substantially continuous spherical surface with a soft tactile feel closely resembling that of the skin of a woman's breast.

2. A ball according to claim 1, wherein said nipple and said ring are darker colored than the surrounding areas of the surface of said ball.

3. A ball according to claim 2, wherein said ring has small rounded bumps therein.

4. A ball according to claim 1, and having a soft outer cover of rubber-like material closely simulating the skin of a woman's breast, and a filler of deformable and resilient viscous material.

5. A ball according to claim 4, wherein said nipple and ring are darker colored than the surrounding areas of the ball surface, and said ring has small rounded bumps therein.

* * * * *